US010026576B2

(12) United States Patent
Tsutsumi et al.

(10) Patent No.: US 10,026,576 B2
(45) Date of Patent: Jul. 17, 2018

(54) DC OPERATED POLARIZED ELECTROMAGNET AND ELECTROMAGNETIC CONTACTOR USING THE SAME

(71) Applicant: FUJI ELECTRIC FA COMPONENTS & SYSTEMS CO., LTD., Tokyo (JP)

(72) Inventors: Takashi Tsutsumi, Tokyo (JP); Masaaki Watanabe, Tokyo (JP); Hideki Daijima, Tokyo (JP); Shota Shiinoki, Tokyo (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 213 days.

(21) Appl. No.: 15/065,268

(22) Filed: Mar. 9, 2016

(65) Prior Publication Data

US 2016/0189901 A1 Jun. 30, 2016

Related U.S. Application Data

(63) Continuation of application No. PCT/JP2015/001945, filed on Apr. 7, 2015.

(30) Foreign Application Priority Data

May 20, 2014 (JP) ..... 2014-104747

(51) Int. Cl.
*H01H 51/01* (2006.01)
*H01H 51/22* (2006.01)
(Continued)

(52) U.S. Cl.
CPC ..... *H01H 51/22* (2013.01); *H01F 7/08* (2013.01); *H01F 7/122* (2013.01); *H01F 7/16* (2013.01);
(Continued)

(58) Field of Classification Search
CPC .... H01H 51/01; H01H 51/2209; H01F 7/122; H01F 7/1615; H01F 7/1623
See application file for complete search history.

(56) References Cited

U.S. PATENT DOCUMENTS 4,947,146 A 8/1990 Ichimura et al.
7,102,475 B2 9/2006 Nakagawa et al.
(Continued)

FOREIGN PATENT DOCUMENTS

CN 102308354 A 1/2012
JP 2011-44278 3/2011
(Continued)

OTHER PUBLICATIONS

Chinese Office Action dated Feb. 14, 2017 in corresponding Chinese Patent Application No. 201580001834.7.
Korean Office Action dated Feb. 20, 2017 in corresponding Korean Patent Application No. 10-2016-7006171.
International Preliminary Report on Patentability dated Dec. 1, 2016 in corresponding International Patent Application No. PCT/JP2015/001945.
(Continued)

*Primary Examiner* — Ramon M Barrera

(57) ABSTRACT

The DC operated polarized electromagnet includes a spool around which an excitation coil is wound and that has a central opening, a plunger having first and second armatures, fitted individually, an outer yoke enclosing opposing side faces of the spool so as to attract the first armature, an inner yoke arranged on the inner side of the outer yoke so as to attract the second armature, and permanent magnets arranged between the outer yoke and the inner yoke, and reduces magnetoresistance by setting the thickness of the outer yoke thicker than the thickness of the inner yoke so that convergent magnetic flux in the plunger is diverted into the outer yoke.

16 Claims, 6 Drawing Sheets

(51) Int. Cl.

| | |
|---|---|
| ***H01F 7/16*** | (2006.01) |
| ***H01F 7/122*** | (2006.01) |
| ***H01H 50/36*** | (2006.01) |
| ***H01F 7/08*** | (2006.01) |
| ***H01H 50/44*** | (2006.01) |
| ***H01H 50/60*** | (2006.01) |
| *H01H 50/54* | (2006.01) |

(52) U.S. Cl.

CPC ..... *H01F 7/1615* (2013.01); *H01F 7/1623* (2013.01); *H01H 50/36* (2013.01); *H01H 50/44* (2013.01); *H01H 50/60* (2013.01); *H01H 51/01* (2013.01); *H01H 51/2209* (2013.01); *H01H 50/546* (2013.01)

(56) References Cited

U.S. PATENT DOCUMENTS

| | | | |
|---|---|---|---|
| 2012/0133462 | A1 | 5/2012 | Naka et al. |
| 2012/0161908 | A1 | 6/2012 | Naka et al. |

FOREIGN PATENT DOCUMENTS

| | | |
|---|---|---|
| JP | 2011-44279 | 3/2011 |
| JP | 2012-195301 | 10/2012 |
| KR | 10-0516546 B1 | 3/2004 |

OTHER PUBLICATIONS

International Search Report dated Jun. 30, 2015, in corresponding International Application No. PCT/JP2015/001945.

Prior Art

DC OPERATED POLARIZED ELECTROMAGNET AND ELECTROMAGNETIC CONTACTOR USING THE SAME

CROSS-REFERENCE TO RELATED APPLICATIONS

This application is a continuation application filed under 35 U.S.C. § 111(a) of International Patent Application No. PCT/JP2015/001945, filed Apr. 7, 2015, which claims the foreign priority benefit under 35 U.S.C. § 119 of Japanese Patent Application No. 2014-104747, filed May 20, 2014, the contents of which are incorporated herein by reference.

TECHNICAL FIELD

The present invention relates to a DC (Direct Current) operated polarized electromagnet the outer yoke and inner yoke of which have permanent magnets interposed therebetween and an electromagnetic contactor using the DC operated polarized electromagnet.

BACKGROUND ART

As an electromagnetic contactor that is equipped with a DC operated polarized electromagnet of this type, for example, an electromagnetic contactor disclosed in PTL 1 has been known.

As illustrated in FIG. 10, a polarized electromagnet applied to the electromagnetic contactor has a configuration in which permanent magnets 103 are interposed between an outside yoke 101 and an inside yoke 102, a first armature 106 and a second armature 107 are formed at both ends in the axial direction of a plunger 105 that is inserted into a cylindrical-shaped excitation coil 104, the first armature 106 is arranged so as to oppose one ends of opposite plate portions 102*a* of the inside yoke 102, and the second armature 107 is arranged so as to oppose the outer side of the outside yoke 101.

CITATION LIST

Patent Literature

PTL 1: JP 2011-44278 A

SUMMARY OF INVENTION

Technical Problem

The above-described conventional polarized electromagnet being excited by energizing the excitation coil 104 so as to be polarized opposite to the polarity of the permanent magnet 103 exerts attractive forces between the first armature 106 and second armature 107 and between left and right end plate portions 101*a* and 101*b* of the outside yoke 101, respectively, and, at the same time, repulsive forces between the first armature 106 on the left side and the opposite plate portions 102*a* of the inside yoke 102. In consequence, the plunger 105 moves left and the armatures 106 and 107 are stuck to the left and right end plate portions 101*a* and 101*b* of the outside yoke 101, respectively.

In general, to satisfy a requirement to miniaturize the polarized electromagnet, the cross-sectional area at a minimum width location of the outside yoke 101 is forced to be set small compared with the cross-sectional area of the plunger 105. For this reason, the magnetoresistance of the outside yoke 101 becomes larger than the magnetoresistance of the plunger 105, which causes magnetic flux produced by energizing the excitation coil 104 to converge toward the inside of the plunger 105 and the amount of magnetic flux passing through the outside yoke 101 to be reduced. In consequence, a reduction in the electromagnetic efficiency of the DC operated polarized electromagnet is caused.

As a result, there is an unsolved problem in that, although DC operated electromagnetic contactors using DC operated polarized electromagnets have been miniaturized due to use of polarized electromagnets, a reduction in a winding amount of an excitation coil to obtain required operational force has not been achieved, DC operated electromagnetic contactors are still large compared with AC (Alternate Current) operated electromagnetic contactors, and high costs are required for manufacturing DC operated electromagnetic contactors.

Accordingly, an embodiment of the present invention is made in consideration of the above-described unsolved problem in conventional examples, and an object of the embodiment of the present invention is to provide a DC operated polarized electromagnet that makes magnetic flux density between a plunger and an outer yoke uniform to enable an improvement in electromagnetic efficiency and an electromagnetic contactor using the DC operated polarized electromagnet.

Solution to Problem

In order to achieve the object mentioned above, according to an aspect of the present invention, there is provided a DC operated polarized electromagnet, including: a spool around which an excitation coil is wound and that has a central opening; a plunger that is inserted into the central opening of the spool and both ends of which, protruding from the central opening, are fitted with first and second armatures individually; an outer yoke that encloses opposing side faces of the spool so as to attract the first armature; an inner yoke that is arranged on the inner side of the outer yoke so as to attract the second armature; and permanent magnets that are arranged between the outer yoke and the inner yoke. A thickness of the outer yoke is set thicker than a thickness of the inner yoke to reduce magnetoresistance of the outer yoke so that convergent magnetic flux in the plunger is diverted into the outer yoke.

In addition, according to another aspect of the present invention, there is provided an electromagnetic contactor including the DC operated polarized electromagnet described above, the plunger of the DC operated polarized electromagnet moving a movable contact holder that holds movable contacts.

Advantageous Effects of Invention

According to an aspect of the present invention, with respect to an outer yoke and an inner yoke that hold permanent magnets therebetween, by setting the thickness of the outer yoke thicker than the thickness of the inner yoke, the magnetoresistance of the outer yoke is reduced. With this configuration, it is possible to suppress convergence of magnetic flux produced when exciting an excitation coil toward the inside of a plunger and divert the magnetic flux to the outer yoke side, which enables an improvement in electromagnetic efficiency to achieve miniaturization.

Further, by using the above-described DC operated polarized electromagnet that can be miniaturized, it is also possible to achieve miniaturization of the configuration of an electromagnetic contactor.

DESCRIPTION OF EMBODIMENTS

Embodiments of the present invention will now be described with reference to the drawings.

Figure 1:
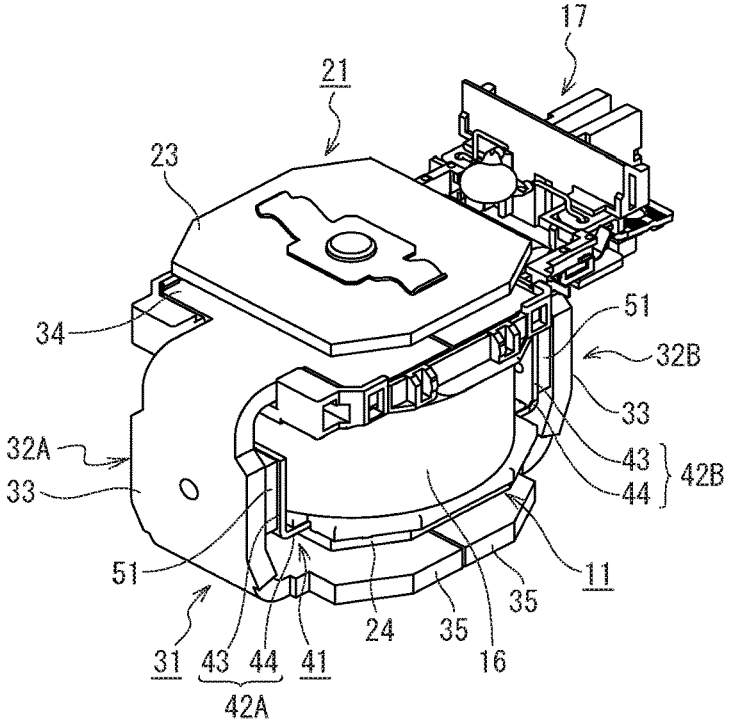
FIG. 1 is an external perspective view illustrating a DC operated polarized electromagnet according to an embodiment of the present invention.
Figure 2:
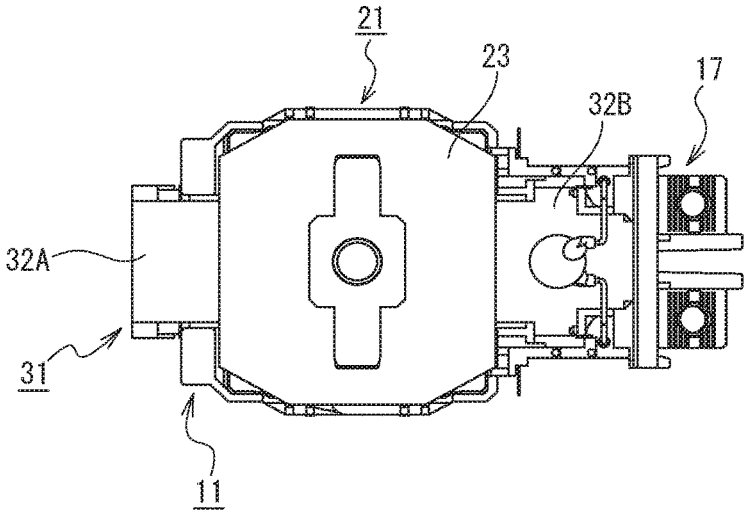
FIG. 2 is a plan view of FIG. 1.
Figure 3:
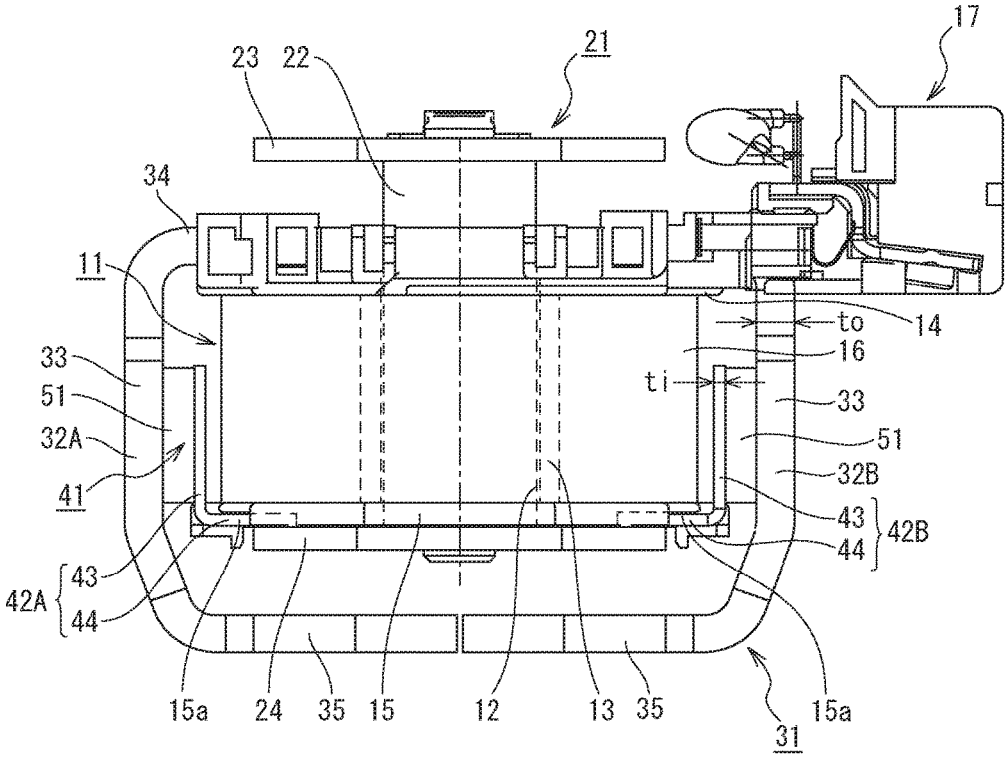
FIG. 3 is an enlarged side view of FIG. 1.

As illustrated in FIGS. 1 to 3, a DC operated polarized electromagnet 10 according to an embodiment of the present invention includes a spool 11, a plunger 21, an outer yoke 31, an inner yoke 41, and permanent magnets 51.

As illustrated in FIG. 3, the spool 11 has a cylinder portion 13 having a central opening 12 and radially protruding flange portions 14 and 15 at the end portions in the axial direction, that is, the top and bottom end portions, of the cylinder portion 13, respectively. An excitation coil 16 is wound between the flange portions 14 and 15 on the outer periphery side of the cylinder portion 13. Further, coil terminals 17 to energize the excitation coil 16 are mounted.

As illustrated in FIG. 3, the plunger 21 includes a columnar bar-shaped portion 22 that is inserted into the central opening 12 of the spool 11 and a first armature 23 and a second armature 24 that are formed in a radially protruding manner at both end portions in the axial direction of the bar-shaped portion 22 that protrude from the central opening 12.

Figure 4:
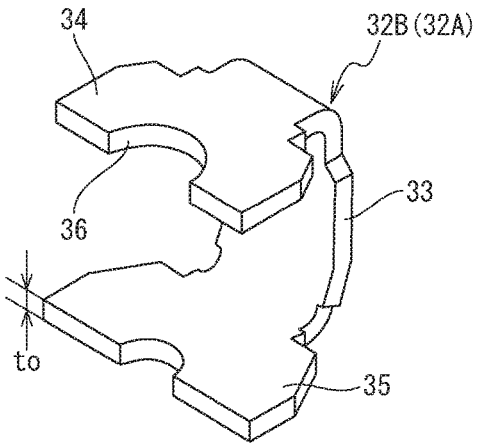
FIG. 4 is a perspective view illustrating a yoke half body of an outer yoke.

As illustrated in FIGS. 1 and 3, the outer yoke 31 includes a pair of left and right yoke half bodies 32A and 32B that oppose each other across the spool 11. As illustrated in FIG. 4, each of the yoke half bodies 32A and 32B has a central plate portion 33 that extends upward and downward along an opposing side face of the spool 11 and opposite plate portions 34 and 35 that extend inward from the top and bottom end portions of the central plate portion 33 along the flange portions 14 and 15 of the spool 11, and is formed in a U-shape when viewed from the side.

As illustrated in FIGS. 1 and 3, the inner yoke 41 includes yoke half bodies 42A and 42B that are arranged on the inner side of the yoke half bodies 32A and 32B of the outer yoke 31 with a predetermined space maintained therebetween. Each of the yoke half bodies 42A and 42B has a vertical plate portion 43 that opposes the central plate portion 33 of either the yoke half body 32A or 32B of the outer yoke 31 and a horizontal plate portion 44 that is arranged in a groove 15*a* formed on the bottom face side of the flange portion 15 of the spool 11 in a radially extending manner from the bottom end side of the vertical plate portion 43, and is formed in an L-shape.

As illustrated in FIGS. 1 and 3, the permanent magnets 51 are individually arranged and interposed between the central plate portions 33 in the yoke half bodies 32A and 32B of the outer yoke 31 and the vertical plate portions 43 opposite thereto of the yoke half bodies 42A and 42B of the inner yoke 41. The outer side and the inner side of each permanent magnet 51 are magnetized to be the north pole and the south pole, respectively.

As illustrated in FIGS. 1 and 3, each of the yoke half bodies 32A and 32B of the outer yoke 31 has the upper opposite plate portion 34 arranged in a manner opposing the top end face of the flange portion 14 of the spool 11 and the lower opposite plate portion 35 arranged below the flange portion 15 of the spool 11 with a predetermined distance maintained therebetween. As illustrated in FIG. 4, on the opposite plate portions 34 of the yoke half bodies 32A and 32B, semicircular notches 36 through which the bar-shaped portion 22 of the plunger 21 is inserted are formed.

The thickness "to" of the yoke half bodies 32A and 32B of the outer yoke 31 is set at, for example, 3.2 mm, and the thickness "ti" of the yoke half bodies 42A and 42B of the inner yoke 41 is set at, for example, 1 mm. Thus, each of the yoke half bodies 32A and 32B, which constitute the outer yoke 31, is formed so that the thickness "to" thereof becomes approximately three times the thickness "ti" of each of the yoke half bodies 42A and 42B, which constitute the inner yoke 41.

As described above, the thickness "to" of the yoke half bodies 32A and 32B of the outer yoke 31 being set to approximately three times the thickness "ti" of the yoke half bodies 42A and 42B of the inner yoke 41 makes it possible to reduce the magnetoresistance of the yoke half bodies 32A and 32B of the outer yoke 31 to be smaller than the magnetoresistance of the yoke half bodies 42A and 42B. Thus, as described later, when magnetic flux is formed in the direction opposite to the magnetization direction of each permanent magnet 51 by energizing the excitation coil 16, it is possible to suppress counter magnetic flux, which is magnetic flux passing in the direction opposite to the magnetization direction of each permanent magnet 51.

The minimum width of each of the yoke half bodies 32A and 32B of the outer yoke 31, that is, the width of one of constricted portions 37 that are formed at connection positions between the central plate portion 33 and the opposite plate portions 34 and 35 disposed at the top and bottom end portions thereof, is set at 16 mm, and the cross-sectional area of one of the constricted portions 37, which has the minimum width, is set at 51.2 $mm^2$. The cross-sectional area at the minimum width location is 1.7 times a cross-sectional area of 30.1 $mm^2$ at a minimum width location of the outside yoke 101 having a constant thickness in the afore-described conventional example.

Figure 10:
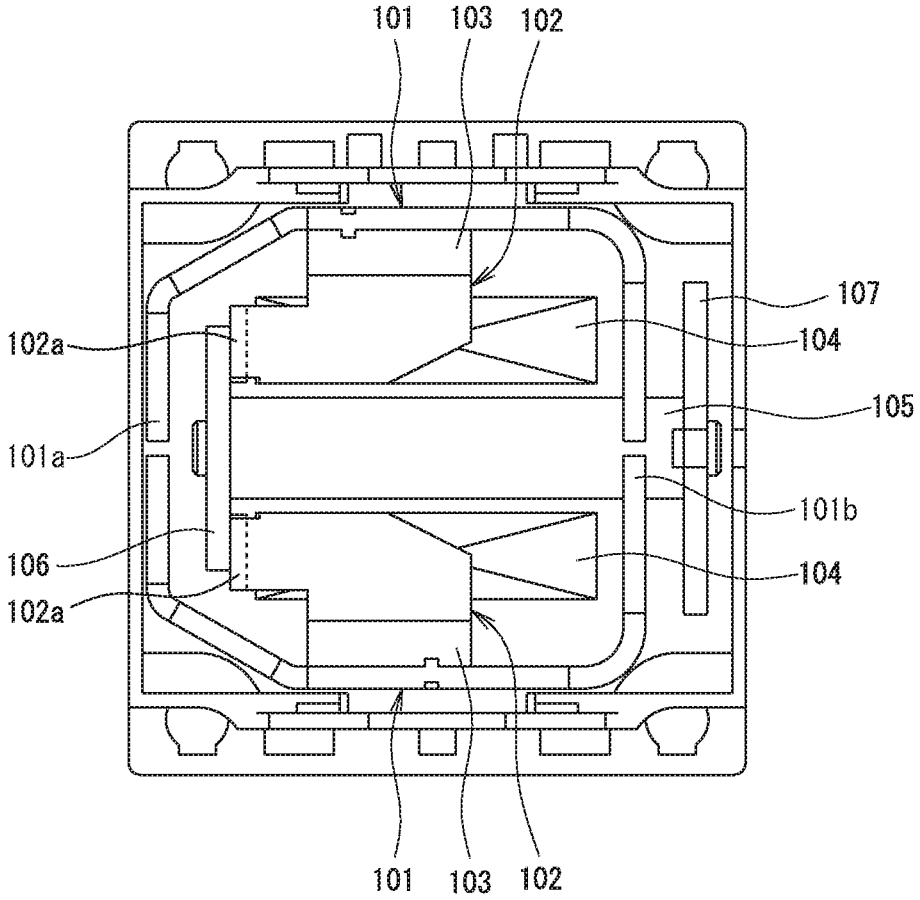
FIG. 10 is a cross-sectional view illustrating a conventional example.

As described above, setting the cross-sectional area at a minimum width location larger than the conventional example by adjusting the thickness and width of the yoke half bodies 32A and 32B of the outer yoke 31 makes it possible to reduce the magnetoresistance of the respective yoke half bodies 32A and 32B to be smaller than the conventional example illustrated in FIG. 10.

Further, using a magnetic material, such as pure iron, that has a sufficiently large relative permeability, which is typically of order 200000, compared with common iron, such as SPCC, which has a relative permeability of 5000, and has a small magnetoresistance for the respective yoke half bodies 32A and 32B of the outer yoke 31 enables a further reduction in the magnetoresistance of the yoke half bodies 32A and 32B.

As described above, reducing the magnetoresistance of the respective yoke half bodies 32A and 32B of the outer yoke 31 makes it possible to, as described later, make convergent magnetic flux produced in the plunger 21 diverged into the yoke half bodies 32A and 32B of the outer yoke 31 when the excitation coil 16 is energized, which enables achieving optimization in the balance of magnetic flux density between the plunger 21 and the yoke half bodies 32A and 32B of the outer yoke 31.

Next, an operation of the above-described first embodiment will be described.

Since, when the excitation coil 16 is in a non-energized state, in which no DC power is supplied to the coil terminals 17, magnetic flux of the permanent magnets 51 is transferred to the horizontal plate portions 44 through the respective yoke half bodies 42A and 42B of the inner yoke 41, the second armature 24 formed on the plunger 21 is attracted to the horizontal plate portions 44. In consequence, as illustrated in FIGS. 1 to 3, the second armature 24 of the plunger 21 is stuck to the horizontal plate portions 44 of the respective yoke half bodies 42A and 42B of the inner yoke 41, which causes the plunger 21 to be positioned at a non-excitation position at which the first armature 23 is separated upward from the opposite plate portions 34 of the respective yoke half bodies 32A and 32B of the outer yoke 31.

Turning the excitation coil 16 into the energized state by supplying DC power to the coil terminals 17 when the plunger 21 is at the non-excitation position makes the excitation coil 16 excited to the opposite polarity to the polarity of the permanent magnets 51. As a result, magnetic flux flows through the plunger 21 directed from the bottom end side to the top end side. The magnetic flux flows from the opposite plate portions 34, which are the upper portions of the respective yoke half bodies 32A and 32B of the outer yoke 31 and are in proximity to the top end side of the plunger 21, to the opposite plate portions 35, which are the lower portions thereof, via the central plate portions 33. In consequence, attractive forces are exerted between the first armature 23 and second armature 24, which are formed on the plunger 21, and the opposite plate portions 34 and 35, which are the upper and lower portions of the outer yoke 31. At the same time, repulsive forces are produced between the second armature 24 on the bottom side and the horizontal plate portions 44 of the respective yoke half bodies 42A and 42B of the inner yoke 41.

For this reason, the plunger 21 moves downward to an excitation position at which the first armature 23 and the second armature 24 are stuck to the opposite plate portion 35 side of the yoke half bodies 32A and 32B of the outer yoke 31.

As described above, when the excitation coil 16 is turned to the energized state and, consequently, to the excitation state, magnetic flux flows through the plunger 21 from the bottom side toward the top side thereof. However, since the magnetoresistances of the respective yoke half bodies 32A and 32B of the outer yoke 31 are set small, the magnetic flux also flows to the yoke half bodies 32A and 32B sides, which causes convergent magnetic flux formed in the plunger 21 to be diverted into the yoke half bodies 32A and 32B and the balance of magnetic flux density to be optimized.

Accordingly, an improvement in electromagnetic efficiency is achieved, which enables a reduction in the number of winding turns of the excitation coil 16 wound around the spool 11 required for obtaining the same operational force by the plunger 21. In consequence, it becomes possible to achieve miniaturization of the DC operated polarized electromagnet 10, which makes it possible to achieve a reduction in cost through achieving a structure to obtain operational force equivalent to operational force obtainable by an AC operated electromagnet with a size equivalent to the size of the AC operated electromagnet.

Further, the opposing areas of the opposite plate portions 34 and 35 of the respective yoke half bodies 32A and 32B of the outer yoke 31 that oppose the first armature 23 and the second armature 24 of the plunger 21 being set larger than the areas of the central plate portions 33 reduces magnetoresistance, which causes transfer of magnetic flux between the opposite plate portions 34 and 35 and the first armature 23 and second armature 24 to be excellently performed.

Moreover, since the thickness "to" of the outer yoke 31 is set to approximately three times the thickness "ti" of the inner yoke 41, the magnetoresistance of the outer yoke 31 is set smaller than the magnetoresistance of the inner yoke 41, which makes it possible to certainly prevent magnetic flux with opposite polarity to the permanent magnets 51 from flowing through the permanent magnets 51 in the opposite direction when the excitation coil 16 is turned to the excitation state.

Further, since the magnetoresistance of a magnetic substance forming the outer yoke 31 is set smaller than the magnetoresistance of a magnetic substance forming the inner yoke 41, it is possible to certainly prevent magnetic flux with opposite polarity to the permanent magnets 51 from flowing through the permanent magnets 51 as with the above description.

Although, in the above-described first embodiment, a case in which the widths of the opposite plate portions 34 and 35 of the respective yoke half bodies 32A and 32B of the outer yoke 31 are set wider than the width of the central plate portions 33 was described, the configuration is not limited to the case. That is, in the embodiment of the present invention, the width of the central plate portions 33 and the widths of the opposite plate portions 34 and 35 may be set to the same width. The cross-sectional area at a minimum width location may be maintained large.

Further, although, in the above-described first embodiment, a case in which the thickness "to" of the outer yoke 31 and the thickness "ti" of the inner yoke 41 are set at 3.2 mm and 1 mm, respectively, was described, the configuration is not limited to the case. The thickness "to" of the outer yoke 31 and the thickness "ti" of the inner yoke 41 may be set to arbitrary values. The thickness "to" of the outer yoke 31 may be set larger than the thickness "ti" of the inner yoke 41 so that the balance of magnetic flux density between the plunger 21 and the outer yoke 31 is optimized.

Next, an electromagnetic contactor using the above-described DC operated polarized electromagnet 10 according to the embodiment of the present invention will be described as a second embodiment with reference to FIGS. 5 to 9.

Figure 5:
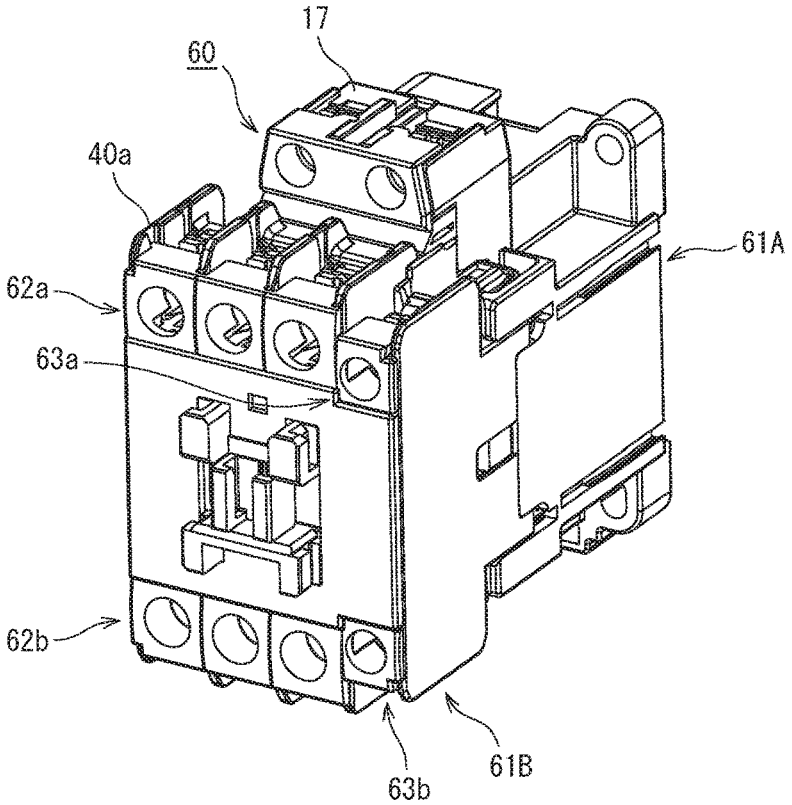
FIG. 5 is an external perspective view illustrating an electromagnetic contactor according to an embodiment of the present invention.

An electromagnetic contactor 60 in the second embodiment is configured with a first frame 61A and a second frame 61B that are coupled with each other, as illustrated in FIG. 5.

Figure 8:
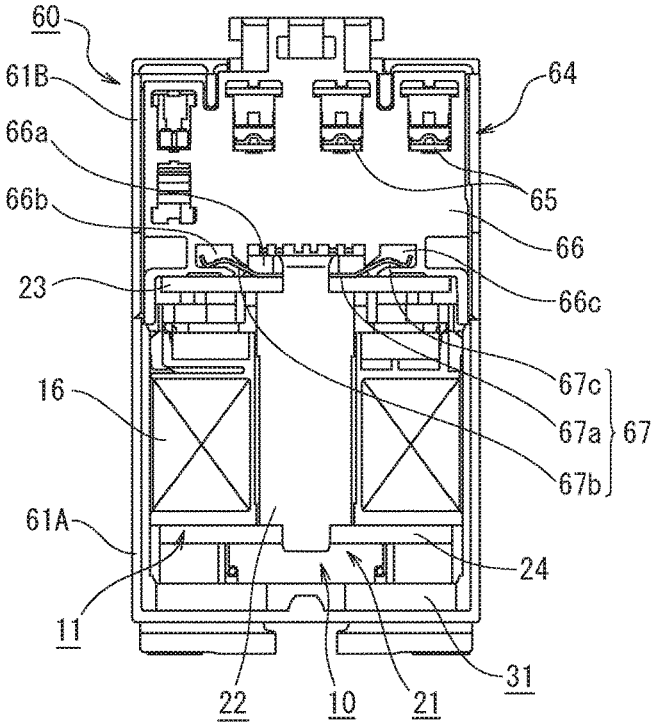
FIG. 8 is a cross-sectional view taken along the line VIII-VIII in FIG. 6.
Figure 9:
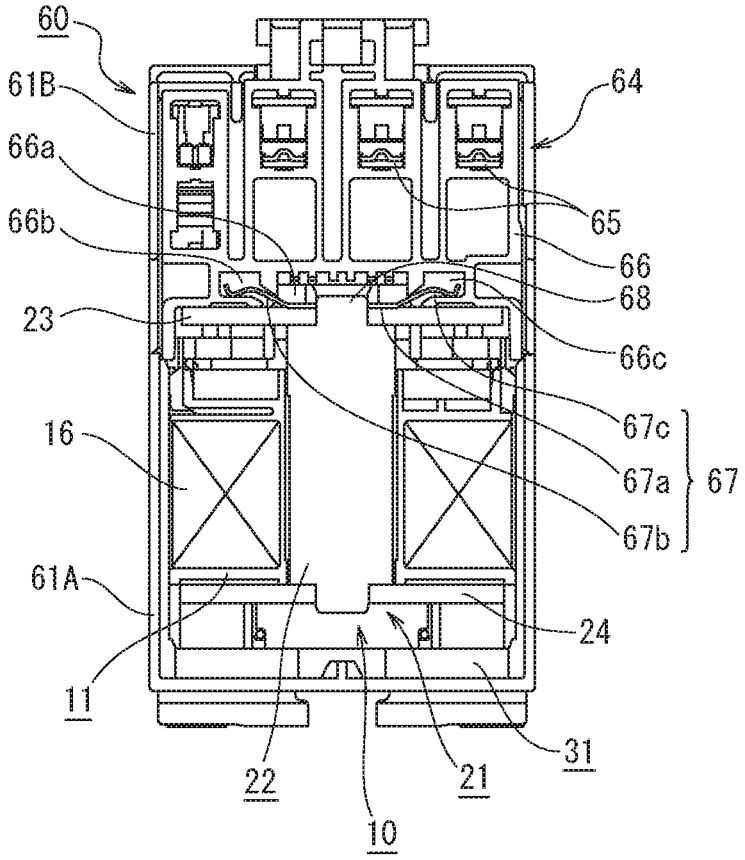
FIG. 9 is a cross-sectional view taken along the line IX-IX in FIG. 6.

As illustrated in FIGS. 8 and 9, a DC operated polarized electromagnet 10, which was described in the afore-described first embodiment, is mounted inside the first frame 61A. The same reference numerals are assigned to components corresponding to the components in the first embodiment and a detailed description thereof will be omitted.

Figure 6:
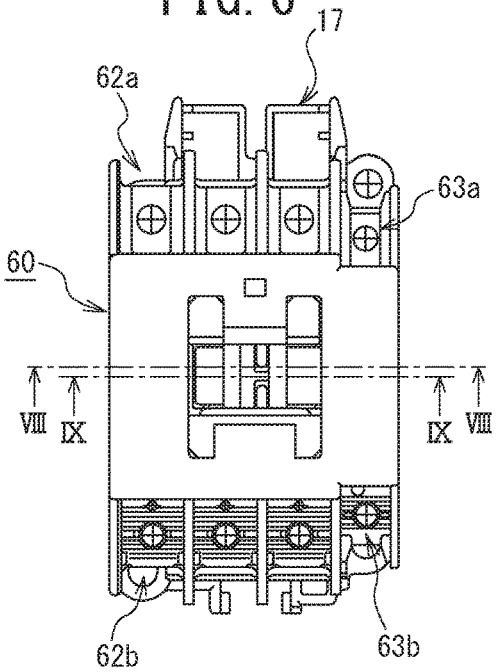
FIG. 6 is a front view of the electromagnetic contactor according to the embodiment of the present invention.

As illustrated in FIGS. 5 and 6, main circuit power supply side terminals 62*a* and an auxiliary terminal 63*a*, which are connected to a three-phase AC power supply, and main circuit load side terminals 62*b* and an auxiliary terminal 63*b*, which are connected to a three-phase load, such as a three-phase electric motor, are formed on, for example, the top end side and the bottom end side, respectively, at the front end of the second frame 61B.

Inside the second frame 61B, a contact mechanism 64, which are on/off driven by the DC operated polarized electromagnet 10, is mounted.

The contact mechanism 64 includes first fixed contacts (not illustrated) that are individually connected to the main circuit power supply side terminals 62*a* and the auxiliary terminal 63*a*, second fixed contacts (not illustrated) that are individually connected to the main circuit load side terminals 62*b* and the auxiliary terminal 63*b*, and a movable contact holder 66 that holds movable contacts 65 each of which is arranged in a contactable and separable manner to and from both one of the first fixed contacts and one of the second fixed contacts.

Figure 7:
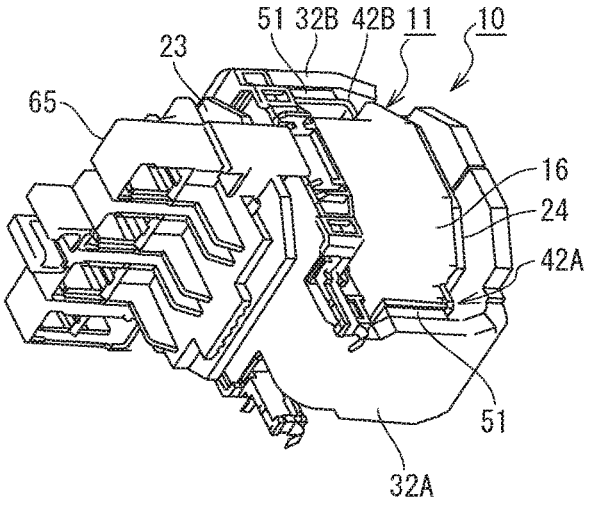
FIG. 7 is a perspective view of FIG. 6 when a first frame and a second frame are removed.

As illustrated in FIGS. 7 to 9, the movable contact holder 66 is coupled with a plunger 21 of the DC operated polarized electromagnet 10. That is, a connecting spring 67 is fixed to the top face of a first armature 23 formed on the plunger 21 by a caulking portion 68. This connecting spring 67 includes a flat plate portion 67*a* in the middle thereof and curved plate portions 67*b* and 67*c* that are formed at both left and right end portions of the flat plate portion 67*a* and have upward convex shapes.

On the other hand, as illustrated in FIGS. 8 and 9, a space portion 66*a* into which the caulking portion 68 of the plunger 21, which fixes the connecting spring 67, is inserted and, on both left and right side of the space portion 66*a*, spring storing portions 66*b* and 66*c* into which the curved plate portions 67*b* and 67*c* of the connecting spring 67 are inserted to be held are formed on the back end face of the movable contact holder 66.

Inserting the curved plate portions 67*b* and 67*c* of the connecting spring 67 fixed on the top face of the first armature 23 into the spring storing portions 66*b* and 66*c* of the movable contact holder 66 so that the curved plate portions 67*b* and 67*c* are held in the spring storing portions 66*b* and 66*c* unites the plunger 21 with the movable contact holder 66.

Next, an operation of the above-described second embodiment will be described. When an excitation coil 16 of the DC operated polarized electromagnet 10 is in the non-energized state and the plunger 21 is positioned at a non-excitation position, the movable contact holder 66 comes into contact with the inner side of the front end of the second frame 61B and each movable contact 65 is separated from a pair of fixed contacts (not illustrated) in the forward direction, as illustrated in FIGS. 8 and 9. In this state, the movable contacts 65 are positioned at an open electrode position at which a main circuit power supply side terminal 62*a* for each phase and a main circuit load side terminal 62*b* for the phase are electrically cut off from each other.

Transferring the plunger 21 from the above-described state to an excitation state by energizing the excitation coil 16 of the DC operated polarized electromagnet 10 moves the plunger 21 in the backward direction, and, at the same time, the movable contact holder 66, which is coupled with the plunger 21 by the connecting spring 67, moves in the backward direction. In consequence, the movable contacts 65 are transferred to a closed electrode state in which a movable contact 65 for each phase comes into contact with a pair of fixed contacts for the phase, and the main circuit power supply side terminals 62*a* and the main circuit load side terminals 62*b* are electrically connected via the movable contacts 65.

Since, according to the second embodiment, the DC operated polarized electromagnet 10 that was described in the afore-described first embodiment moves the movable contact holder 66, as described above, and the DC operated polarized electromagnet 10 can be miniaturized to a size equivalent to the size of a common AC operated electromagnet, which produces the same operational force as the DC operated polarized electromagnet 10, it is possible to reduce the height of the first frame 61A, which stores the DC operated polarized electromagnet 10. As a result, the overall height of the electromagnetic contactor 60 can be reduced, making it possible to miniaturize the electromagnetic contactor 60.

Moreover, since the DC operated polarized electromagnet 10 can be miniaturized to a size equivalent to the size of an AC operated electromagnet, which produces the same operational force as the DC operated polarized electromagnet 10, it becomes possible to store either the DC operated polarized electromagnet 10 or an AC operated electromagnet in a structure including the first frame 61A and the second frame 61B, which enables the first frame 61A and the second frame 61B to be used in common.

REFERENCE SIGNS LIST

10 DC operated polarized electromagnet
11 Spool
12 Central opening
13 Cylinder portion
14, 15 Flange portion
16 Excitation coil
21 Plunger
22 Bar-shaped portion
23 First armature
24 Second armature
31 Outer yoke
32A, 32B Yoke half body
33 Central plate portion
34, 35 Opposite plate portion
41 Inner yoke
42A, 42B Yoke half body
43 Vertical plate portion
44 Horizontal plate portion
51 Permanent magnet
60 Electromagnetic contactor
61A First frame
61B Second frame
62*a* Main circuit power supply side terminal
62*b* Main circuit load side terminal
63*a*, 63*b* Auxiliary terminal
65 Movable contact
66 Movable contact holder
66*a* Space portion
66*b*, 66*c* Spring storing portion
67 Connecting spring

The invention claimed is:

1. A DC operated polarized electromagnet, comprising:

a spool around which an excitation coil is wound and that has a central opening;

a plunger that is inserted into the central opening of the spool and both ends of which, protruding from the central opening, are fitted with first and second armatures individually;

an outer yoke including a central plate portion and a pair of opposite plate portions that are formed at both ends of the central plate portion, the outer yoke being formed so that widths of the pair of opposite plate portions are wider than a width of the central plate portion, and the outer yoke enclosing opposing side faces of the spool so as to attract the first armature;

an inner yoke that is arranged on an inner side of the outer yoke so as to attract the second armature; and permanent magnets that are arranged between the outer yoke and the inner yoke, wherein a thickness of the outer yoke is set thicker than a thickness of the inner yoke.

2. The DC operated polarized electromagnet according to claim 1, wherein the central plate portion opposes a side face of the spool, and the pair of opposite plate portions are formed at both ends of the central plate portion in a central axial direction of the spool to be formed in a U-shape.

3. The DC operated polarized electromagnet according to claim 1, wherein the thickness of the outer yoke is set to three times the thickness of the inner yoke so that magnetoresistance of the outer yoke is set smaller than magnetoresistance of the inner yoke.

4. The DC operated polarized electromagnet according to claim 1, wherein magnetoresistance of a magnetic substance that forms the outer yoke is set smaller than magnetoresistance of a magnetic substance that forms the inner yoke.

5. An electromagnetic contactor comprising the DC operated polarized electromagnet according to claim 1, the plunger of the DC operated polarized electromagnet moving a movable contact holder that holds movable contacts.

6. The DC operated polarized electromagnet according to claim 2, wherein the thickness of the outer yoke is set to three times the thickness of the inner yoke so that magnetoresistance of the outer yoke is set smaller than magnetoresistance of the inner yoke.

7. The DC operated polarized electromagnet according to claim 2, wherein magnetoresistance of a magnetic substance that forms the outer yoke is set smaller than magnetoresistance of a magnetic substance that forms the inner yoke.

8. The DC operated polarized electromagnet according to claim 3, wherein magnetoresistance of a magnetic substance that forms the outer yoke is set smaller than magnetoresistance of a magnetic substance that forms the inner yoke.

9. The DC operated polarized electromagnet according to claim 6, wherein magnetoresistance of a magnetic substance that forms the outer yoke is set smaller than magnetoresistance of a magnetic substance that forms the inner yoke.

10. An electromagnetic contactor comprising the DC operated polarized electromagnet according to claim 2, the plunger of the DC operated polarized electromagnet moving a movable contact holder that holds movable contacts.

11. An electromagnetic contactor comprising the DC operated polarized electromagnet according to claim 3, the plunger of the DC operated polarized electromagnet moving a movable contact holder that holds movable contacts.

12. An electromagnetic contactor comprising the DC operated polarized electromagnet according to claim 4, the plunger of the DC operated polarized electromagnet moving a movable contact holder that holds movable contacts.

13. An electromagnetic contactor comprising the DC operated polarized electromagnet according to claim 6, the plunger of the DC operated polarized electromagnet moving a movable contact holder that holds movable contacts.

14. An electromagnetic contactor comprising the DC operated polarized electromagnet according to claim 7, the plunger of the DC operated polarized electromagnet moving a movable contact holder that holds movable contacts.

15. An electromagnetic contactor comprising the DC operated polarized electromagnet according to claim 8, the plunger of the DC operated polarized electromagnet moving a movable contact holder that holds movable contacts.

16. An electromagnetic contactor comprising the DC operated polarized electromagnet according to claim 9, the plunger of the DC operated polarized electromagnet moving a movable contact holder that holds movable contacts.

* * * * *